US007429215B2

(12) United States Patent
Rozkin et al.

(10) Patent No.: US 7,429,215 B2
(45) Date of Patent: Sep. 30, 2008

(54) SYSTEM AND METHOD FOR PROVIDING SIDE WAGERING IN MULTI-PLAYER WAGER-BASED GAMES

(75) Inventors: Sergiy Rozkin, Toronto (CA); Vladimir Dunaevsky, Toronto (CA); John Kennedy FitzGerald, Toronto (CA); Serge Bourenkov, Toronto (CA)

(73) Assignee: CryptoLogic Inc., Toronto (CA)

( * ) Notice: Subject to any disclaimer, the term of this patent is extended or adjusted under 35 U.S.C. 154(b) by 651 days.

(21) Appl. No.: 10/948,287

(22) Filed: Sep. 24, 2004

(65) Prior Publication Data

US 2006/0073882 A1 Apr. 6, 2006

(51) Int. Cl.
*A63F 9/24* (2006.01)

(52) U.S. Cl. ..... 463/25; 463/13; 463/16; 463/42

(58) Field of Classification Search ..... None
See application file for complete search history.

(56) References Cited

U.S. PATENT DOCUMENTS 5,283,734 A * 2/1994 Von Kohorn ..... 463/17
5,390,934 A * 2/1995 Grassa ..... 273/292
5,451,054 A * 9/1995 Orenstein ..... 273/148 R
5,697,844 A * 12/1997 Von Kohorn ..... 463/40
5,735,742 A * 4/1998 French ..... 463/25
5,833,536 A * 11/1998 Davids et al. ..... 463/11
6,050,895 A * 4/2000 Luciano et al. ..... 463/7
6,508,709 B1 * 1/2003 Karmarkar ..... 463/42
6,688,978 B1 * 2/2004 Herman ..... 463/25
6,991,544 B2 * 1/2006 Soltys et al. ..... 463/42
2001/0019965 A1 * 9/2001 Ochi ..... 463/25
2002/0037767 A1 * 3/2002 Ebin ..... 463/25
2002/0084587 A1 * 7/2002 Bennett et al. ..... 273/309
2004/0135316 A1 * 7/2004 Lipscomb ..... 273/274

* cited by examiner

*Primary Examiner*—M. A Sager
(74) *Attorney, Agent, or Firm*—Bereskin & Parr

(57) ABSTRACT

A system and method for providing side wagering in a wager-based game. Side wagers made by an observer of the wager-based game are accepted, where the side wager is associated with an event that is uncertain at the time the side wager is made. The event is associated with at least one player of the wager-based game. A payout based on the side wager is calculated and provided to the observer if the event occurs. In one embodiment of the invention, player ratings may also be provided to facilitate the making of side wagers.

8 Claims, 7 Drawing Sheets

SYSTEM AND METHOD FOR PROVIDING SIDE WAGERING IN MULTI-PLAYER WAGER-BASED GAMES

FIELD OF THE INVENTION

The invention relates generally to wager-based games, and more specifically, to a system and method for providing side wagering in multi-player wager-based games.

BACKGROUND OF THE INVENTION

A wager-based game may be generally defined as a game in which one or more players can place a wager or bet on an outcome that is uncertain at the time the wager is made.

In some wager-based games, a wager made by a player is accepted by a "house", which may be representative of a gaming establishment hosting the particular game, for example. If the outcome is realized, the house provides a payout based on the wager made in accordance with established rules governing the particular game. Many popular casino games (e.g., Blackjack, Roulette, Craps, Baccarat, Let it Ride®, Caribbean Stud Poker®), fall into this category of wager-based games. In such games, payouts on player wagers are typically provided by the house when the player wins in accordance with the rules of the respective games, as may be the case if a player holds a hand (of playing cards) that beats the hand of a house dealer, or if the player successfully predicts the outcome of a random event associated with the roll of dice or the spinning of a wheel, for example. Some of these wager-based games allow players to make supplemental or side wagers in addition to their main wagers, for which separate payouts are provided by the house to the player if a particular event occurs (e.g. the player is dealt a specific hand of a set of pre-defined hands).

In another form of wager-based games, wagers are made between multiple players of a game, played between players and not against a house. Some variations of the game of poker (e.g. Texas Hold'em, Seven Card Stud, Omaha) fall into this category of wager-based games. In such games, wagers may be made by players at various stages during the play of a hand, each player betting that he will "win" the hand in accordance with the rules of the particular game being played. At the completion of a hand, each winner is then generally entitled to at least a portion of all wagers made during the play of that hand. In these types of games, although a house does not typically participate by playing a hand, in games hosted by a gaming establishment, a portion of all wagers made during the play of the hand (i.e. a rake) may be collected by the house before payouts are distributed to each winner.

Gaming establishments that host wager-based games are no longer restricted to traditional brick-and-mortar establishments, such as casinos. Online or Internet gaming is steadily increasing in popularity. Many games that are currently played online are electronic manifestations of already popular games that were traditionally only played "live".

SUMMARY OF THE INVENTION

In one broad aspect of the invention, there is provided a system and method for providing side wagering in a wager-based game, the method comprising the steps of: accepting a side wager made by an observer of a wager-based game playable by a plurality of players, wherein the side wager is associated with an event in the wager-based game that is uncertain at the time the side wager is made, wherein the event is associated with at least one of the plurality of players; determining whether the event with which the side wager is associated has occurred; calculating a payout based on the side wager if the event associated with the side wager has occurred; and providing the payout to the observer.

In another broad aspect of the invention, there is provided a system and method of providing player ratings for a wager-based game, the method comprising the steps of: computing a player rating for each of a plurality of players of the wager-based game, based on historical data associated with past play of the wager-based game by the respective player, in accordance with a pre-determined algorithm; and displaying the player rating for each of at least a first player of the plurality of players to each of at least a second player of the plurality of players.

BRIEF DESCRIPTION OF THE DRAWINGS

For a better understanding of embodiments of the invention, and to show more clearly how it may be carried into effect, reference will now be made, by way of example, to the accompanying drawings in which.

DETAILED DESCRIPTION OF EMBODIMENTS OF THE INVENTION

Figure 1:
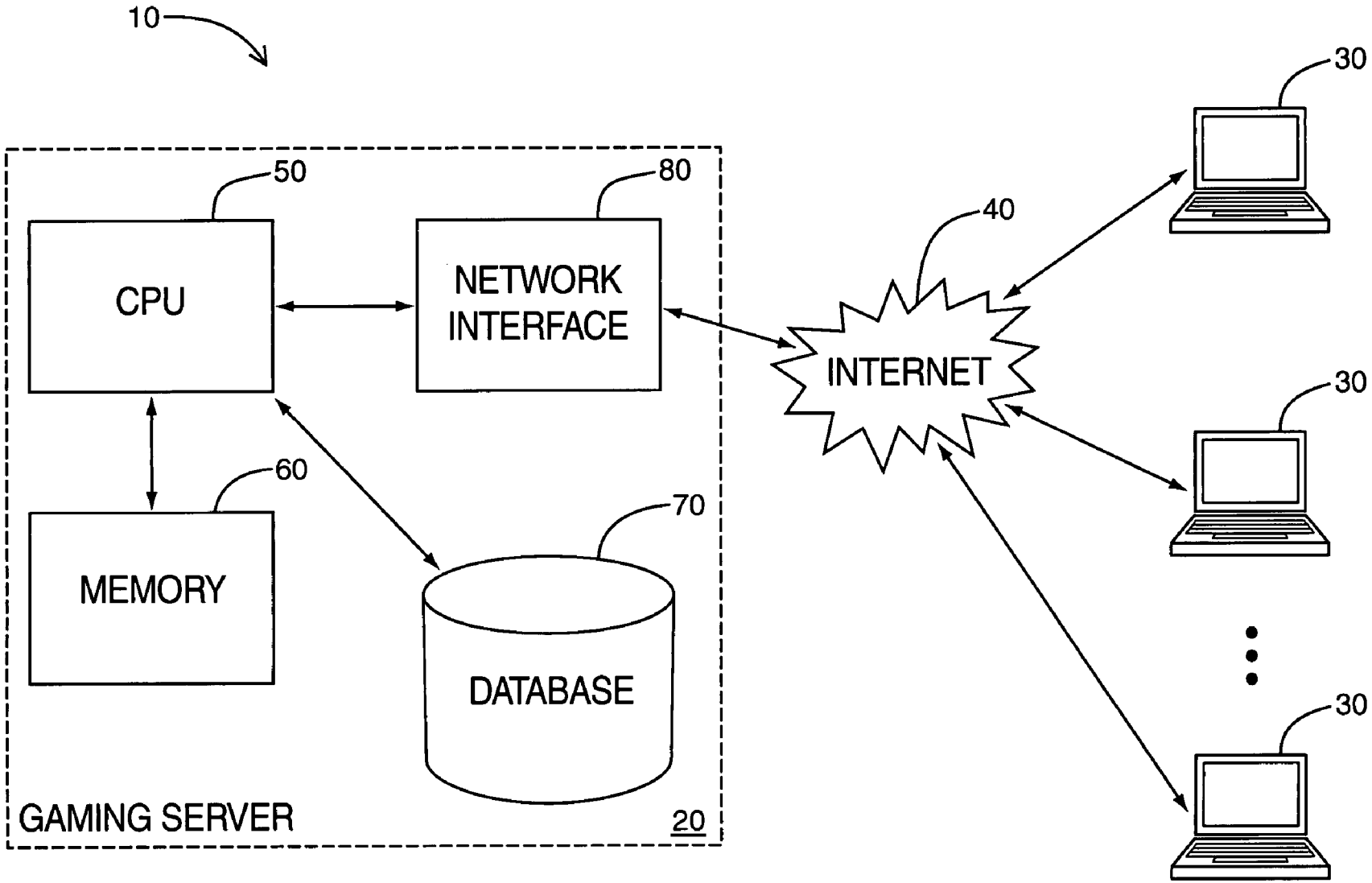
FIG. 1 is a schematic diagram illustrating components of an online gaming system operable within a network of computing devices in an example implementation of an embodiment of the invention.

In accordance with one broad aspect, the invention is generally directed to a system and method for providing side wagering in a wager-based game playable by multiple players, in which side wagers may be made by an observer of the wager-based game. This differs from known wager-based games in which the players themselves may place side wagers when playing a wager-based game. By allowing observers to make side wagers, an additional level of wagering is introduced, associated with the play of the wager-based game. In this respect, a new and unique model adapted for use with existing wager-based games, including many casino-based games for example, is provided in one aspect of the invention. A gaming establishment (i.e. the "house") can potentially benefit from increased revenue by collecting a portion of side wagers made. Observers are provided with the opportunity to profit from their side wagers. Enhanced entertainment value may be realized by participants (e.g. players and observers) of wager-based games incorporating the new model.

In accordance with this broad aspect of the invention, the side wager is associated with a specific event in the wager-based game that is uncertain at the time the side wager is made. The event is also associated with a particular player of the wager-based game. For example, an observer may be betting on the possibility that a particular player of the wager-based game will win a future tournament in which the game is played, that a particular player of the wager-based game will win a hand, round, or session of the game about to be played, that a particular player will receive a specific hand within a specified period, or more generally, any other event that is determinable but has not yet occurred. While the wager-based game is or will be played by multiple players, in one embodiment of the invention, the side wagers are made by participants who are not players of the game, and who are thus at least one level removed from the actual play of the game.

In instances where side wagers are made on events that depend at least in part on the skill of a particular player, it may be beneficial to provide observers with information that they can use, in deciding whether a particular side wager should be placed or the amount of such side wager. Accordingly, in one embodiment of the invention, there is provided a system and method for providing player ratings for the wager-based game. A player rating for each player of the wager-based game is computed based on historical data associated with past play of the wager-based game by the respective player in accordance with a pre-determined algorithm. The player rating for a particular player can be displayed to other players and/or observers, possibly at the option of the player in an embodiment of the invention. By using player ratings in the consideration of making side wagers, decisions by observers to make side wagers on certain events need not be made completely at random. Player ratings may also be employed by the players themselves to aid them in determining potential opponents, for example.

In one embodiment of the invention, where player ratings are displayed at the option of the players, the players may be provided with a financial incentive by the house for enabling the display of their player rating. For example, a portion of profits made by the house from side wagers may be distributed to players who allow their player ratings to be exposed.

Referring to FIG. 1, a schematic diagram illustrating components of an online gaming system operable within a network of computing devices in an example implementation of an embodiment of the invention is shown generally as 10.

In one embodiment of the invention, system 10 is implemented by an online gaming server 20 to which multiple computing devices 30 (e.g. a personal computer) can connect through the Internet 40, or other private or public network, allowing wager-based games hosted by gaming server 20 to be played online by multiple participants. In the example implementation shown, gaming server 20 comprises a central processing unit (CPU) 50, memory 60, a database 70, and a network interface 80 through which gaming server 20 connects to the Internet 40. It will be understood by persons skilled in the art that gaming server 20 will generally comprise additional internal and peripheral components not shown in FIG. 1, and that other configurations of gaming server 20 are possible in variant implementations of embodiments of the invention.

In variant embodiments of the invention, computing devices 30, connected to a gaming server 20 through the Internet 40, or other private or public network, need not be limited to personal computers, but may also include other devices such as, for example, interactive TV, wireless mobile devices, and any other communication device or gaming device comprising a display or other output device that would permit users of the devices to receive information and participate in the wager-based game hosted by the gaming establishment maintaining gaming server 20.

The term "participant" as used herein, generally denotes not only players who are involved in the actual play of the wager-based game, but also observers that are not involved in the actual play of the wager-based game but who receive information on the wager-based game being played by the players. In some implementations of embodiments of the invention, the "house" may also be considered as a player where, for example, a house dealer participates in the actual play of the wager-based game. Other participants may also be associated with the wager-based game.

Figure 2:
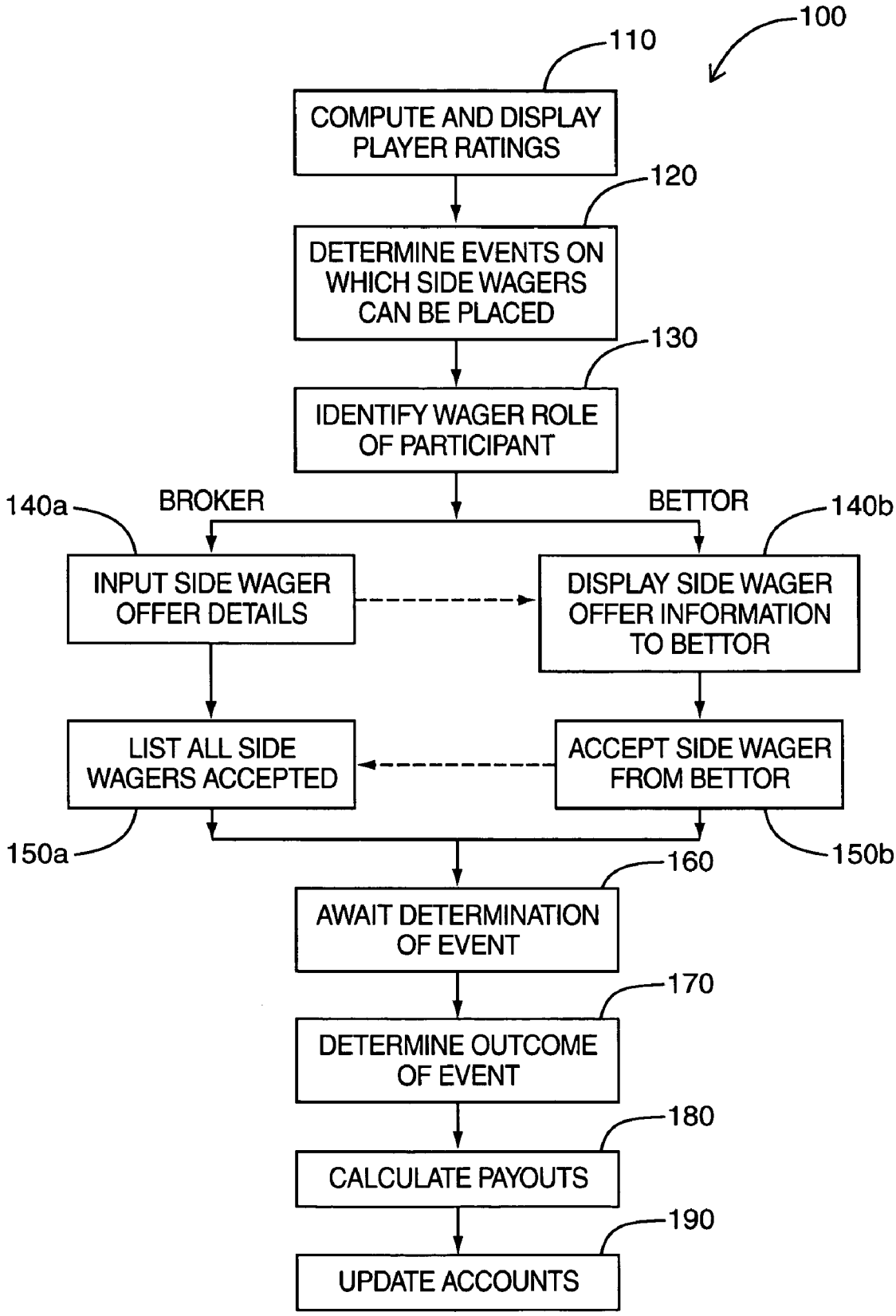
FIG. 2 is a flowchart illustrating the steps of a method of providing side wagering in a wager-based game in an embodiment of the invention.

Referring to FIG. 2, a flowchart illustrating the steps of a method of providing side wagering in a wager-based game in an embodiment of the invention is shown generally as 100. In this embodiment of the invention, the wager-based game is hosted by an online gaming server (e.g. gaming server 20 of FIG. 1), and participants of the wager-based game operate computing devices (e.g. computing devices 30 of FIG. 1) equipped with a display in playing the wager-based game.

At step 110, player ratings are computed and optionally displayed for each player to play in the wager-based game. Each player can be assigned a rating, which can be tracked by the online gaming server. Player ratings are computed based on historical data (e.g. stored in a database such as database 70 of FIG. 1), which is associated with past play of the wager-based game by each respective player. As games are played, the player ratings can also be updated in real-time to reflect recent performance that results in a change in the ratings of one or more players.

Player ratings can be employed by the gaming server to inform participants of the wager-based game (e.g. players and/or observers) of the relative ability of players. Making the player ratings available to observers can facilitate the making of side wagering decisions that would otherwise require observers to predict the outcome of games, or more generally, the outcome of certain events, based purely on the results of their own analysis or by random guessing. For example, a lower rating might indicate to an observer that a particular player has a greater propensity to lose, and therefore, ought to warrant better odds for a wager on the event that the player will actually win a particular tournament, game, hand, etc. Information from player ratings may still be combined with an observer's own knowledge in determining whether a side wager should be made.

Player ratings, when applied to multi-player wager-based games, can offer several advantages. Players may benefit in that an additional feature is available for tracking individual comparative performance. Player ratings may provide a mechanism that allows observers to make more informed side wagers in wager-based games. The provision of side wagering in wager-based games may benefit both the gaming establishment hosting the wager-based game and observers making successful side wagers with an opportunity for increased revenues.

Player ratings may be computed in accordance to any predefined algorithm or standard. Generally, a player rating will reflect the relative or absolute ranking of game players. For example, points can be assigned to players based on performance following a league-style of scoring similar to that used in professional hockey, or a tournament-style of scoring similar to that used in professional golf, tennis, or in a Chess Federation rating system.

Player ratings may facilitate the division of players into a number of groups, and be used to organize leagues and tournaments, for example. This may facilitate competition between players considered to be of similar skill level based on ranking.

A player may also utilize player ratings to help him determine whether he should play against other players based on their player ratings. In that case, a player may regard the rating of another player as an indication of how difficult it would be to beat that player in a particular game.

In one embodiment of the invention, each player may be provided with the option of whether his rating will be displayed to other participants. Gaming establishments may provide incentives for a player to display his rating to other participants.

At step 120, one or more events on which observers may place side wagers are determined. Each event may be a single, or a combination of, discrete states or outcomes that may result with some likelihood of occurrence during the play of the wager-based game.

In an implementation of this embodiment where the wager-based game is one played with playing cards, observers could make side wagers on the likelihood that, for example:

- at least one specific player will win (or lose) a hand to be played;
- at least one specific player will win (or lose) the hand currently being played, with the side wager being made after commencement of the hand but before the hand is completed;
- at least one specific player will win (or lose) a tournament to be played, where multiple hands are played in the tournament;
- at least one specific player will win (or lose) the tournament currently being played, with the side wager being made after commencement of the tournament but before the tournament is completed;
- at least one specific player will (or will not) be dealt a particular hand or one or more particular cards in the current or an upcoming deal; and/or
- at least one specific player will win (or lose) a particular number of hands in a row.

It will be understood by persons skilled in the art that the foregoing events are provided as examples only, and that other events can be defined on which side wagers may be made in variant implementations of embodiments of the invention.

At step 130, input is received from a participant that identifies his role with respect to the offering and making of side wagers. In this embodiment of the invention, a participant can choose to act as a broker, by presenting side wager offers to potential betters, or as a bettor who will make side wagers. Typically, each bettor and broker will be a non-playing observer of the wager-based game.

A broker presents a side wager offer by selecting an event and offering odds that a particular outcome will be realized. The bettor can select an offer of a particular broker, by placing a wager with that broker.

At step 140*b*, information on side wagers being offered by brokers is displayed to a bettor. In an embodiment of the invention, a list of available offers that the bettor can select from is provided. The displayed information may include, for example, the name (or other identifier) of each broker, the odds being offered (e.g. the rate of return on a successful wager), and the size of the minimum and maximum wagers being accepted by the respective broker; this information having been input by the respective broker at corresponding step 140*a*.

In one embodiment of the invention, each event is associated with a particular player (e.g. that the particular player will win the next hand, etc.). In this case, step 140*b* may also comprise selecting the particular player. The information on side wagers being offered by brokers and displayed at step 140*b* as described above would then be related to events associated with player as selected. Accordingly, brokers may provide different offers for side wagers on events associated with one or more different players.

In one embodiment of the invention, steps 140*a* and 140*b* may be repeated, so as to allow brokers to change the terms of a side wager offer, if it has not been accepted by a bettor within a period of time for example.

In one embodiment of the invention, side wagers may be made on events associated only with players that have their respective player ratings displayed.

At step 150*b*, a side wager is accepted from the bettor. Information required to accept a side wager offer from a broker is received from a bettor. For example, the bettor may select an offer from a broker, and input the size of the wager he would like to make. The amount of the wager may be deducted from an account established by the bettor with the gaming establishment hosting the wager-based game, pending determination of whether the event on which the side wager is made has occurred.

From the broker's perspective, confirmation of the side wager made may then be provided to the broker at step 150*a*. The confirmation may be in the form of an entry in a listing, where the listing identifies observers who have accepted a side wager offer from that broker and the amount of each side wager.

In some implementations, side wager offers from a broker may be accepted by only one bettor, while in other implementations, side wager offers from a broker may be accepted by multiple bettors. Limits may be optionally set on the total amount of side wagers that may be accepted from multiple bettors. An amount associated with the potential payout of the side wagers made may be deducted from an account established by the broker with the gaming establishment hosting the wager-based game, pending determination of whether the event on which the side wagers are made has occurred.

In one embodiment of the invention, a portion of the side wagers made and/or offered may be withheld for collection by the gaming establishment (i.e. as a rake). In another embodiment of the invention, the gaming establishment may act as a broker and/or a bettor.

In one embodiment of the invention, a participant in the wager-based game may act as a broker in one or more transactions, and simultaneously as a bettor in one or more other transactions.

At step 160, bettors await the determination of the event. In one embodiment of the invention, all participants of the wager-based game are able to watch the progress of the game, in real-time.

In this embodiment of the invention, the wager-based game is played by players through computing devices connected to the gaming server. However, in a variant embodiment of the invention, the wager-based game is not a game played by players connected to the gaming server. For example, the wager-based game may be a "live" game, where a simulation of the game is displayed to brokers and bettors. In this case, the gaming system acts as a wagering system that facilitates the offering and making of side wagers, but which does not provide game playing capabilities.

At step 170, a determination of whether the event with which the side wager is associated has occurred is made. The outcome of the side wager and thus whether or not the bettor was successful or not is determined.

At step 180, payouts based on the side wager if the event associated with the side wager has occurred are calculated. In an embodiment of the invention, a successful bettor would receive a payout equal to the wager multiplied by the odds (less any rake), while a corresponding loss would accrue to the broker. Conversely, if the bettor were unsuccessful, the broker would receive a payout equal to the wager (less any rake), while a corresponding loss would accrue to the bettor. It will be understood by persons skilled in the art that one of many other payout schemes may be employed in calculating payouts to brokers and bettors in variant embodiments of the invention.

At step 190, the payouts calculated at step 180 are made to the broker and bettor. This may entail, for example, crediting and debiting accounts for the broker and bettor maintained by the gaming establishment or a third party appropriately.

Figure 3:
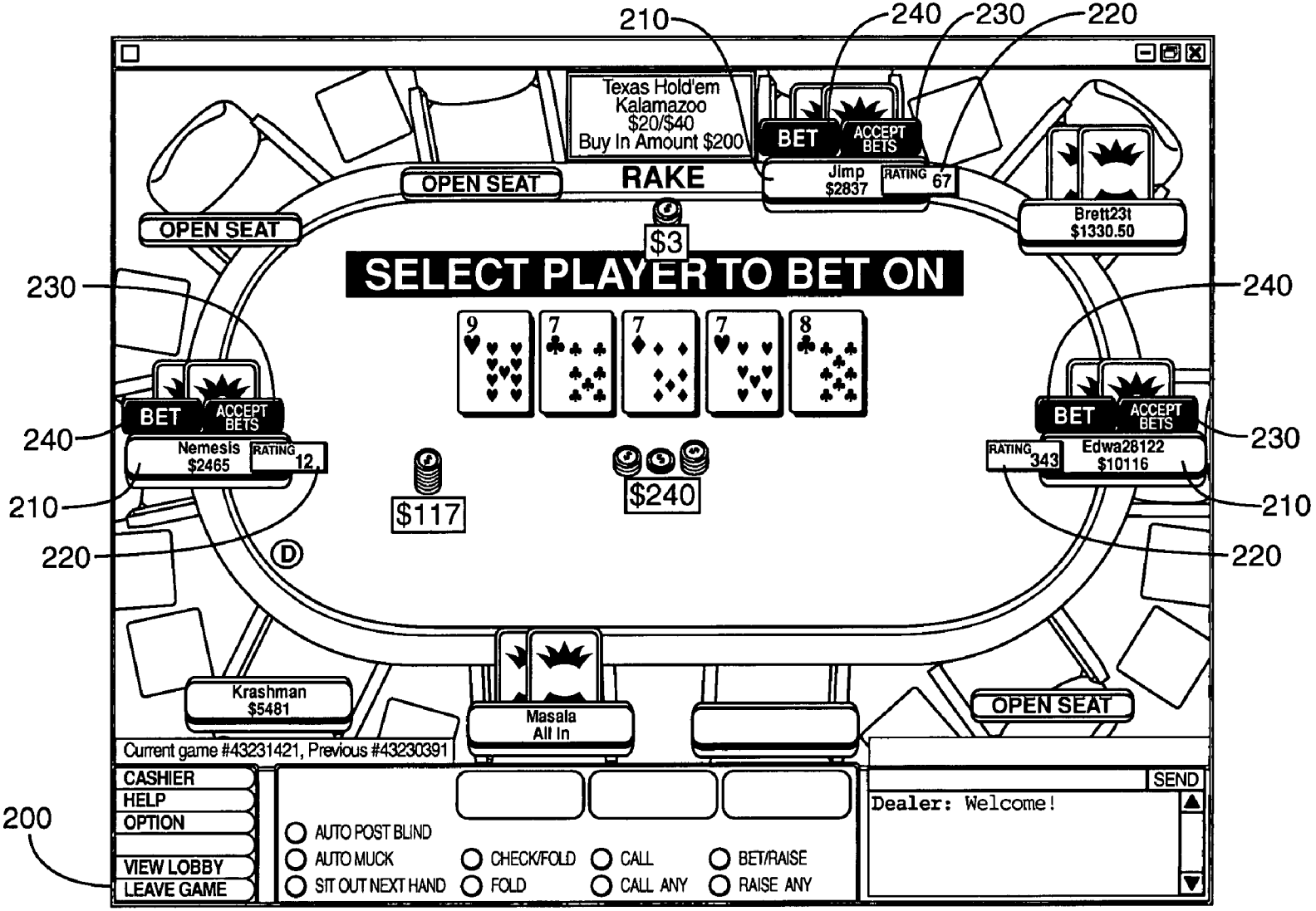
FIGS. 3-7 are example screenshots illustrating various display features in a user interface for a computing device display in an example implementation of an embodiment of the invention.

Referring now to FIGS. 3-7, example screenshots illustrating various display features in a user interface of a computing device display (e.g. a display of computing device 30 of FIG. 1) in an example implementation of an embodiment of the invention are shown in screen 200 of FIG. 3. In this example, a game of poker is depicted, in which players make wagers during the play of the game. An identifier for each player 210 is shown.

Observers of the wager-based game may select a player 210 on which to make a side wager. In this example implementation, an observer can make a side wager that the selected player 210 will win the next hand. Player ratings 220 are displayed to participants of the wager-based game. Observers are provided with the option to act as a broker 230 and the option to act as a bettor 240.

Figure 4:
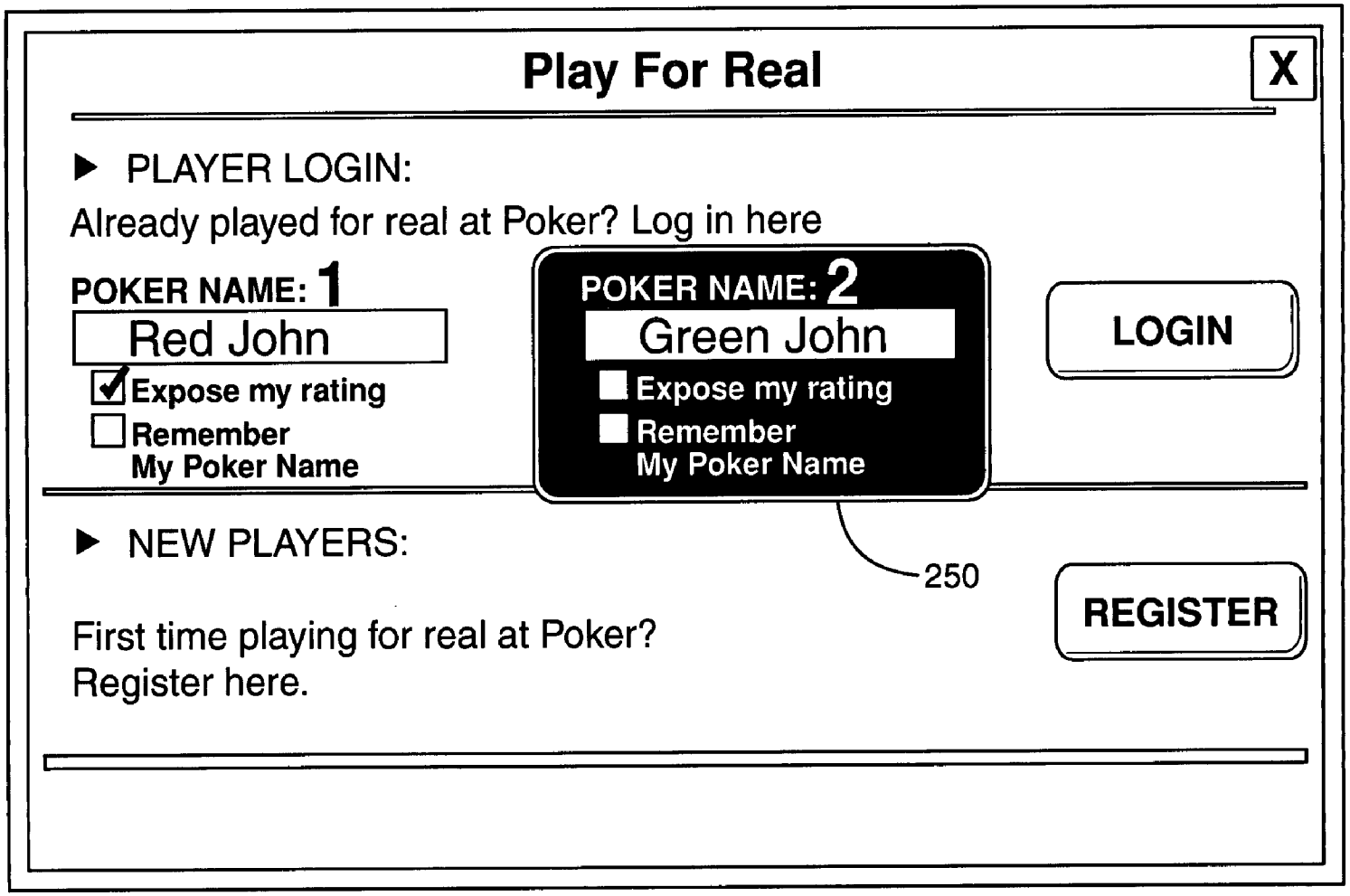

In this example implementation, players may choose not to display their player ratings. FIG. 4 depicts a dialog box showing privacy element 250, which a player who chooses not to display his player rating may select. In this example implementation, side wagers are not permitted in association with players who do not display their player ratings. In an embodiment of the invention, a player can have a primary alias and a secondary alias. The player can use the secondary alias to play with a non-exposed rating (e.g. to play a poker game without receiving benefit from side bets made) or use the primary analysis to play with an exposed rating (e.g. to take profit from side betting activity).

Figure 5:
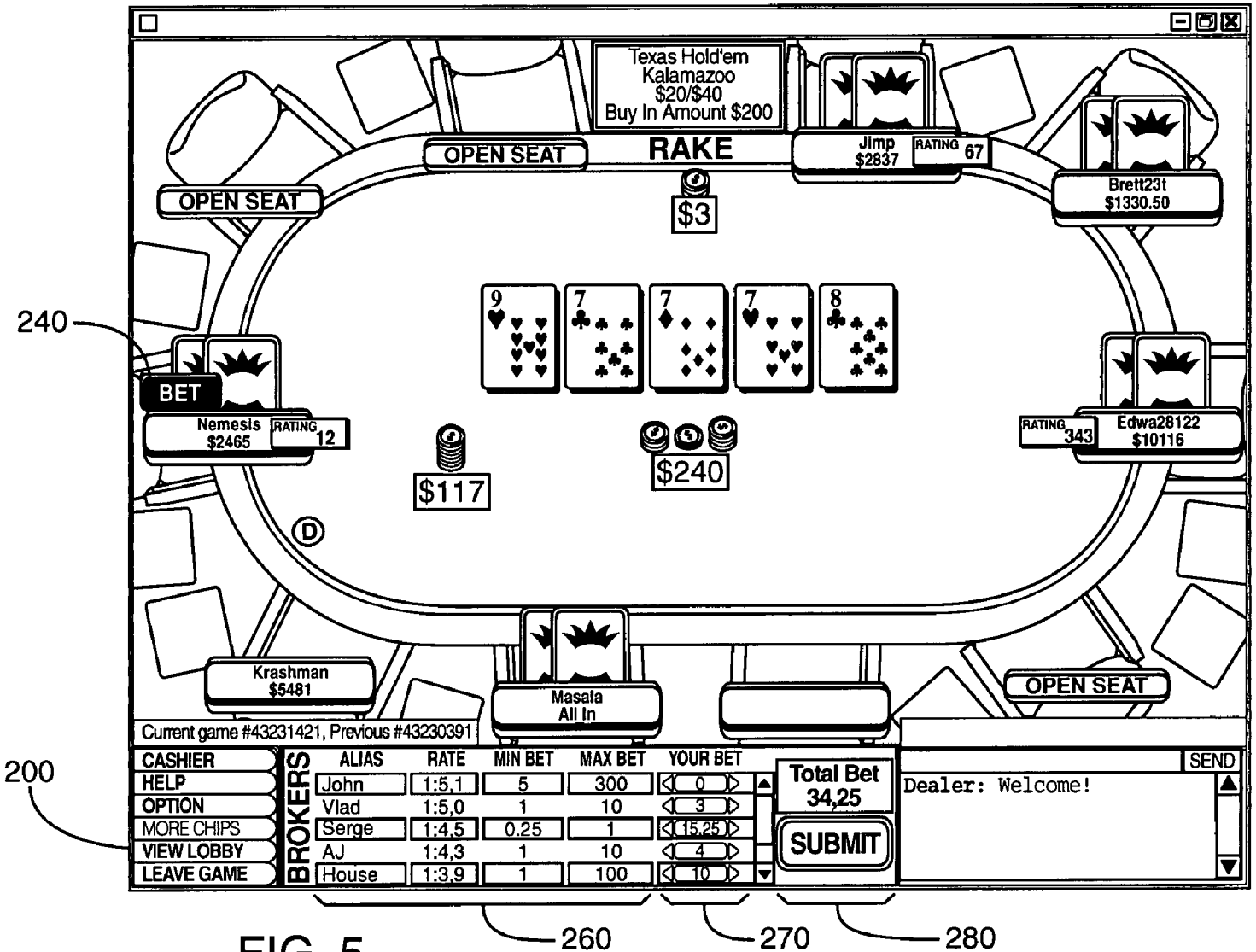

FIG. 5 depicts an example display in screen 200 in which an observer has selected bettor option 240. Information regarding side wager offers provided by various brokers is shown at 260. Fields 270 into which the observer can input side wager amounts are provided. The total amount of side wagers to be made and a request to accept the side wagers is also provided, as shown at 280.

Figure 6:
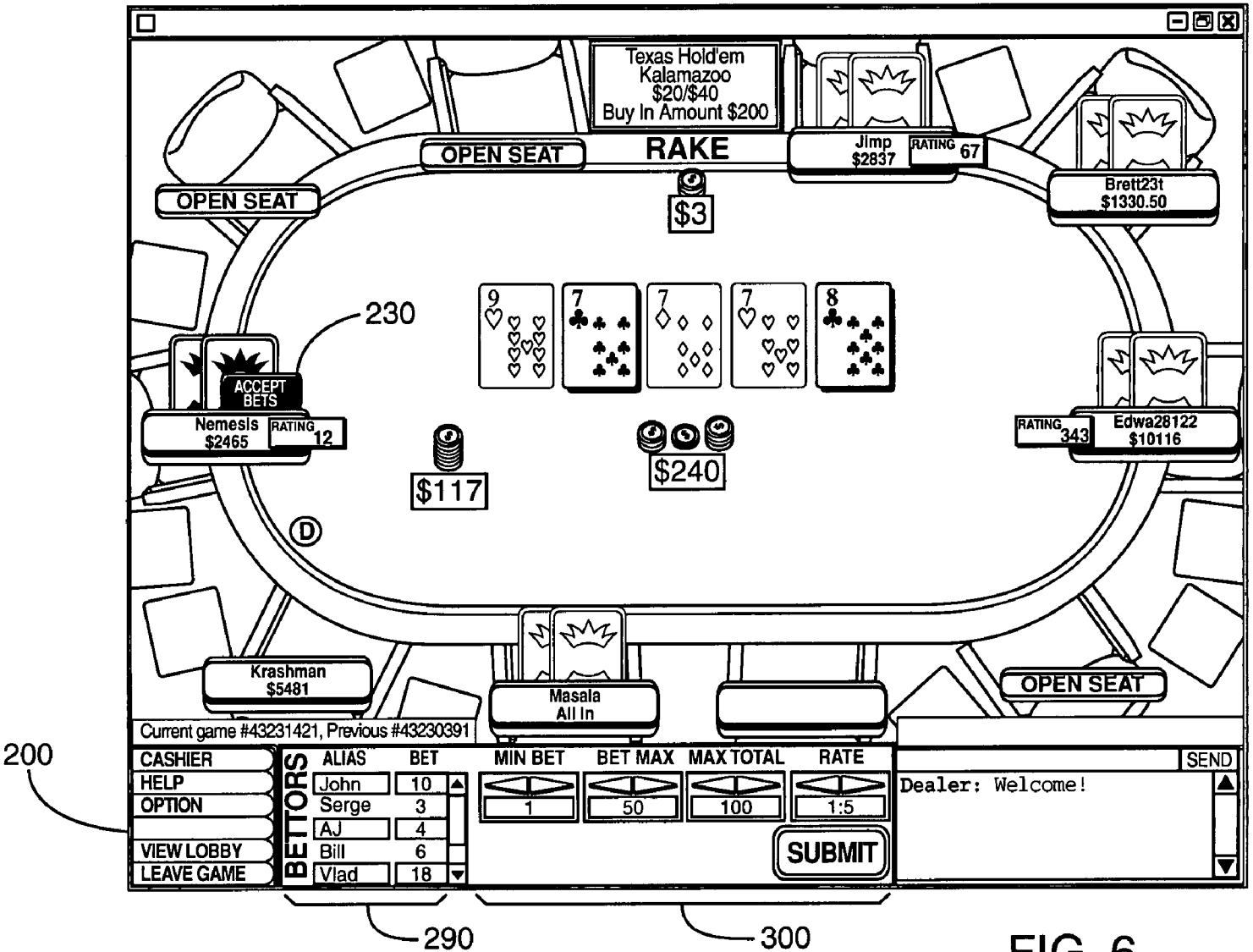

From the broker's perspective, FIG. 6 depicts an example display in screen 200 in which the observer has selected broker option 230. Information regarding side wager offers made by bettors is shown at 290. Fields 300 into which the observer can modify side wager offers, and a request to submit the offers to bettors is also provided, also shown at 300.

Figure 7:
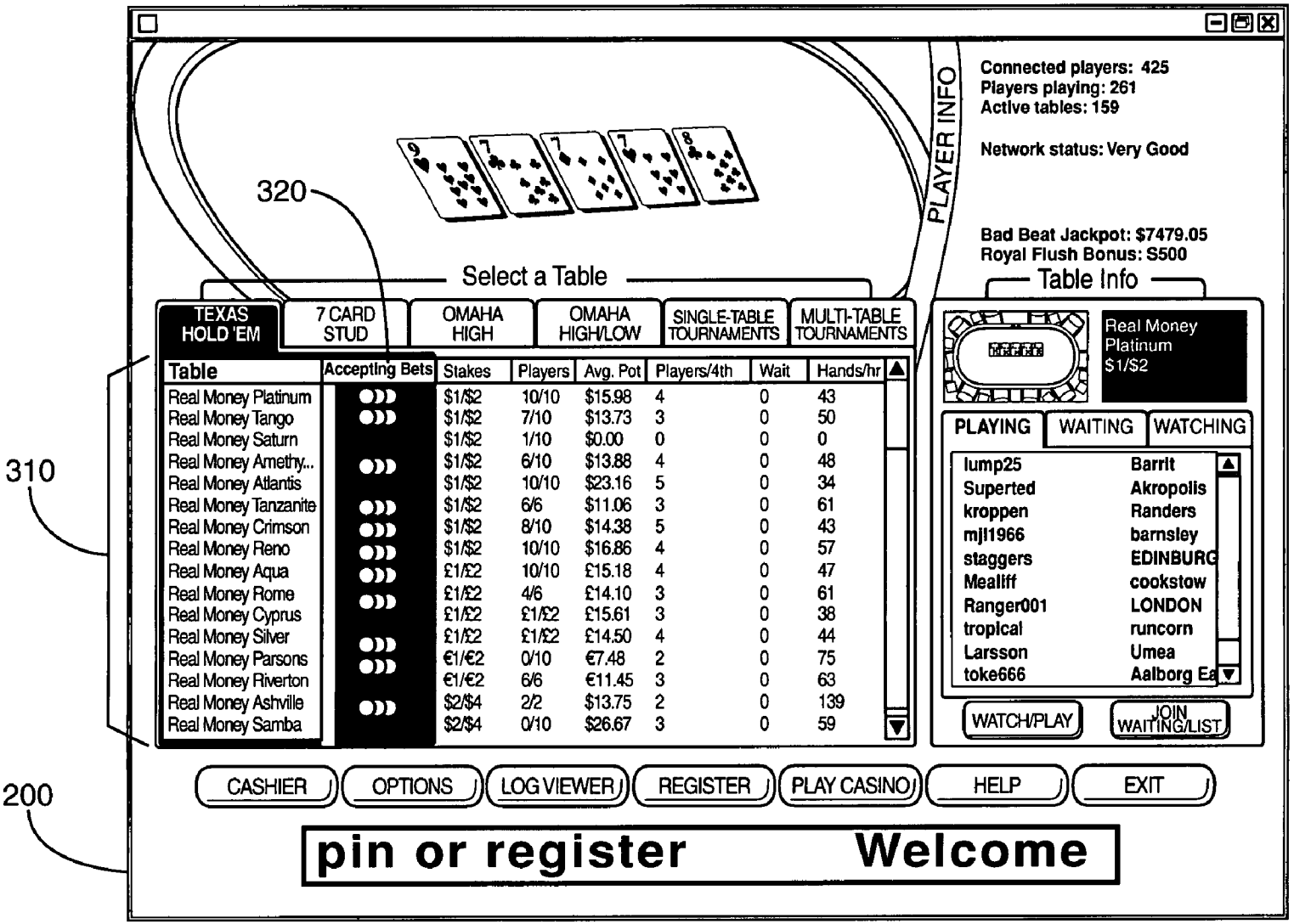

FIG. 7 depicts an example display in screen 200 for a game lobby, in which a variety of wager-based games are provided in a games list 310. Wager-based games in which side wagers may be made in accordance with an embodiment of the invention, are identified in field 320 of games list 310.

These screenshots depict example displays on a computing device and it will be understood by persons skilled in the art that other displays for a computing device may be implemented, and other displays modified for other gaming devices may be implemented, without departing from the scope of the invention.

It will be understood by persons skilled in the art that implementations of embodiments of the invention are not limited to systems and methods where the wager-based game is a poker game. Embodiments of the invention may be applied in respect of other wager-based games, including card based and non-card based casino games for example. Furthermore, embodiments of the invention are not limited to implementations where such games are playable online.

Instructions for performing one or more steps of a method of providing side wagering in a wager-based game in an embodiment of the invention may be provided on computer-readable media, which is intended to include transmission-type media.

The invention has been described with regard to a number of embodiments. However, it will be understood by persons skilled in the art that other variants and modifications may be made without departing from the scope of the invention as defined in the claims appended hereto.

The invention claimed is:

1. A method for providing side wagering in a wager-based game played by a plurality of players, the method comprising the steps of:

a) displaying a player rating for at least one of the plurality of players of the wager-based game;

b) providing the at least one of the plurality of players with an option to prevent display of the player rating to an observer;

c) accepting a side wager made by the observer of the wager-based game, wherein the side wager is associated with an event in the wager-based game that is uncertain at the time the side wager is made, wherein the event is associated with the at least one of the plurality of players;

d) determining whether the event with which the side wager is associated has occurred;

e) calculating a payout based on the side wager if the event associated with the side wager has occurred; and f) providing the payout to the observer.

2. The method of claim 1, wherein the wager-based game playable by the plurality of players is playable online.

3. The method of claim 1, further comprising the step of offering odds for the side wager, wherein the payout is calculated based on the offered odds.

4. The method of claim 1, wherein the player rating for each player is computed based on historical data associated with past play of the wager-based game by the respective player, in accordance with a pre-determined algorithm.

5. The method of claim 1, further comprising providing an incentive to the at least one of the plurality of players to display the player rating.

6. The method of claim 1, further comprising:

re-computing the player rating for each of the plurality of players of the wager-based game after the event in the wager-based game; and displaying a re-computed player rating for the at least one player to the observer.

7. A software program for execution on a computing device, the program comprising a plurality of instructions stored on a computer-readable medium, wherein the instructions, when executed, perform the steps of:

a) displaying a player rating for at least one of a plurality of players of a wager-based game;

b) providing the at least one of the plurality of players with an option to prevent display of the player rating to an observer;

c) accepting a side wager made by the observer of the wager-based game, wherein the side wager is associated with an event in the wager-based game that is uncertain at the time the side wager is made, wherein the event is associated with the at least one of the plurality of players;

d) determining whether the event with which the side wager is associated has occured;

e) calculating a payout based on the side wager if the event associated with the side wager has occurred; and f) providing the payout to the observer.

8. A system for providing side wagering in a wager-based game played by a plurality of players, the system comprising:

at least one processor, a memory coupled to the at least one processor, and a network interface coupled to the at least one processor, wherein the system is accessible over a communication network by a plurality of players through the network interface, wherein the processor executes a plurality of instructions for:

a) displaying a player rating for at least one of the plurality of players of the wager-based game;

b) providing the at least one of the plurality of players with an option to prevent display of the player rating to an observer;

c) accepting a side wager made by the observer of the wager-based game, wherein the side wager is associated with an event in the wager-based game that is uncertain at the time the side wager is made, wherein the event is associated with the at least one of the plurality of players;

d) determining whether the event with which the side wager is associated has occurred;

e) calculating a payout based on the side wager if the event associated with the side wager has occurred; and f) providing the payout to the observer.

* * * * *